US010056051B2

(12) United States Patent
Jang et al.

(10) Patent No.: US 10,056,051 B2
(45) Date of Patent: Aug. 21, 2018

(54) DISPLAY APPARATUS AND METHOD OF DRIVING THE SAME

(71) Applicant: Samsung Display Co., Ltd., Yongin-si, Gyeonggi-Do (KR)

(72) Inventors: Ji-Eun Jang, Cheonan-si (KR); Go-Eun Cha, Cheonan-si (KR); Ji-Hye Choi, Suwon-si (KR); Hoi-Sik Moon, Asan-si (KR); Jae-Seok Choi, Uijeongbu-si (KR); Shim-Ho Yi, Seoul (KR); Jong-Hee Na, Asan-si (KR); Woo-Young Lee, Hwaseong-si (KR); Woo-Jin Jung, Asan-si (KR); Kang-Hyun Kim, Seoul (KR); Jun-Il Park, Cheonan-si (KR); Jung-Suk Han, Hwaseong-si (KR); Jae-Seob Chung, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 384 days.

(21) Appl. No.: 14/807,662

(22) Filed: Jul. 23, 2015

(65) Prior Publication Data

US 2016/0247483 A1 Aug. 25, 2016

(30) Foreign Application Priority Data

Feb. 25, 2015 (KR) ..... 10-2015-0026495

(51) Int. Cl.

| | |
|---|---|
| ***G09G 3/36*** | (2006.01) |
| ***G09G 5/10*** | (2006.01) |
| ***G09G 5/18*** | (2006.01) |

(52) U.S. Cl.
CPC ... *G09G 3/3648* (2013.01); *G09G 2320/0673* (2013.01); *G09G 2360/16* (2013.01)

(58) Field of Classification Search
None
See application file for complete search history.

(56) References Cited

U.S. PATENT DOCUMENTS

2006/0238472 A1* 10/2006 Lee ..... G09G 3/3688 345/89
2008/0136761 A1 6/2008 Hong et al.
(Continued)

FOREIGN PATENT DOCUMENTS

KR 10-2008-0054190 A 6/2008
KR 10-2011-0126862 A 11/2011
(Continued)

*Primary Examiner* — Kent Chang
*Assistant Examiner* — Benjamin Morales Fernande
(74) *Attorney, Agent, or Firm* — H.C. Park & Associates, PLC

(57) ABSTRACT

A display apparatus includes a gamma controller configured to determine whether the target pixel unit is driven in both time division method and space division method based on a plurality of comparison values and a reference condition, and an output controller configured to generate normal gamma-data of the target pixel unit using a normal gamma curve if the plurality of comparison values satisfy the reference condition and to generate high gamma-data and low gamma-data of the target pixel unit using a high gamma curve and a low gamma curve in both time division method and space division method if the plurality of comparison values do not satisfy the reference condition.

20 Claims, 11 Drawing Sheets

(56) References Cited

U.S. PATENT DOCUMENTS

| | | | | |
|---|---|---|---|---|
| 2008/0238936 | A1* | 10/2008 | Kim | G09G 3/3648 345/618 |
| 2010/0007680 | A1* | 1/2010 | Yu | G09G 3/2003 345/690 |
| 2015/0145898 | A1* | 5/2015 | Hwang | G09G 3/3688 345/690 |
| 2016/0027390 | A1 | 1/2016 | Kim et al. | |

FOREIGN PATENT DOCUMENTS

| | | | |
|---|---|---|---|
| KR | 10-2013-0134567 | A | 12/2013 |
| KR | 10-2014-0003146 | A | 1/2014 |
| KR | 10-2014-0006404 | A | 1/2014 |
| KR | 10-2014-0033951 | A | 3/2014 |
| KR | 1020160011817 | A | 2/2016 |

* cited by examiner

DISPLAY APPARATUS AND METHOD OF DRIVING THE SAME

CLAIM OF PRIORITY

This application claims the priority of and all the benefits accruing under 35 U.S.C. §119 of Korean Patent Application No. 10-2015-0026495 filed on Feb. 25, 2015 in the Korean Intellectual Property Office (KIPO), which is hereby incorporated by reference for all purposes as if fully set forth herein.

BACKGROUND OF THE INVENTION

1. Field of Disclosure

Exemplary embodiments of the inventive concept relate to a display apparatus, a method of driving the display apparatus. More particularly, example embodiments of the inventive concept relate to a display apparatus for improving a display quality and a method of driving the display apparatus.

2. Description of the Related Art

A liquid crystal display ("LCD") panel may include a thin film transistor ("TFT") substrate, an opposing substrate and an LC layer disposed between the two substrates. The TFT substrate may include a plurality of gate lines, a plurality of data lines crossing the gate lines, a plurality of TFTs connected to the gate lines and the data lines, and a plurality of pixel electrodes connected to the TFTs. A TFT may include a gate electrode extended from a gate line, a source electrode extended to a data line, and a drain electrode spaced apart from the source electrode.

The LCD panel may not emit light by itself. In other words, it is not self-emissive. The LCD panel may receive light from the backside of the LCD panel or from the front of the LCD panel. The LCD panel may have limited side visibility. To improve the side visibility, a multi-domain technique may be used. In the multi-domain technique, an area in which a pixel electrode is formed is divided into a plurality of domains, and LC molecules of the LC layer are arranged according to the domain in which they are located. This spatial division method has difficulty of optimizing luminance or transmittance level.

SUMMARY OF THE INVENTION

Exemplary embodiments of the inventive concept provide a display apparatus for improving a display quality in both time division method and space division method.

Exemplary embodiments of the inventive concept provide a method of driving the display apparatus.

According to an exemplary embodiment of the inventive concept, there is provided a display apparatus. The display apparatus includes a comparison value detector configured to calculate a plurality of comparison values using data of a target pixel unit and a plurality of peripheral pixel units adjacent to the target pixel unit, a gamma controller configured to determine whether the target pixel unit is driven in both time division method and space division method based on the plurality of comparison values and a reference condition, an output controller configured to generate normal gamma-data of the target pixel unit using a normal gamma curve if the plurality of comparison values satisfies the reference condition and to generate high gamma-data and low gamma-data of the target pixel unit using a high gamma curve and a low gamma curve in both time division method and space division method if the plurality of comparison values does not satisfy the reference condition, and a data driver configured to convert gamma data of the target pixel unit to a data voltage and to output the data voltage to a display panel.

In an exemplary embodiment, the display apparatus may further include a line memory configured to store data of the target pixel unit and the peripheral pixel units.

In an exemplary embodiment, the plurality of comparison values may include a representative value of the target pixel unit and representative values of the peripheral pixel units.

In an exemplary embodiment, when the representative values of the peripheral pixel units are equal to each other and different from the representative value of the target pixel unit, the output controller may be configured to generate the normal gamma-data of the target pixel unit.

In an exemplary embodiment, the gamma controller may be configured to determine that the representative values of the peripheral pixel units are equal to each other when a difference value between the representative values of the peripheral pixel units is less than a first threshold value, and to determine that the representative values of the peripheral pixel units are different from each other when the difference value between the representative values of the peripheral pixel units is more than the first threshold value.

In an exemplary embodiment, the gamma controller may be configured to determine that the representative values of the target and peripheral pixel units are equal to each other when a difference value between the representative values of the peripheral pixel units is less than a second threshold value, and to determine that the representative values of the target and peripheral pixel units are different from each other when the difference value between the representative values of the peripheral pixel units is more than the second threshold value.

In an exemplary embodiment, the plurality of comparison values may include a maximum value, a minimum value, a maximum difference value between the maximum value and the minimum value of the target pixel unit and the peripheral pixel units.

In an exemplary embodiment, the output controller may be configured to generate the normal gamma-data of the target pixel unit when the minimum value is less than the first threshold value.

In an exemplary embodiment, the output controller may be configured to generate the normal gamma-data of the target pixel unit when the maximum difference value is less than the second threshold value.

In an exemplary embodiment, the target pixel unit and the peripheral pixel units may be arranged as an (n×m) matrix array ('n' and 'm' are natural numbers and equal to or different from each other).

In an exemplary embodiment, the target pixel unit may be located at a central area in the (n×m) matrix array.

According to an exemplary embodiment of the inventive concept, there is provided a method of driving the display apparatus. The method includes calculating a plurality of comparison values using data of a target pixel unit and a plurality of peripheral pixel units adjacent to the target pixel unit, determining whether the target pixel unit is driven in both time division method and space division method based on the plurality of comparison values and a reference condition, generating normal gamma-data of the target pixel unit using a normal gamma curve if the plurality of comparison values satisfies the reference condition, generating high gamma-data and low gamma-data of the target pixel unit using a high gamma curve and a low gamma curve in both time division method and space division method if the plurality of comparison values does not satisfy the reference condition, and converting gamma data of the target pixel unit to a data voltage to output the data voltage to a display panel.

In an exemplary embodiment, the plurality of comparison values may include a representative value of the target pixel unit and representative values of the peripheral pixel units.

In an exemplary embodiment, the method may further include generating the normal gamma-data of the target pixel unit, when the representative values of the peripheral pixel units are equal to each other and different from the representative value of the target pixel unit.

In an exemplary embodiment, the method may further include determining that the representative values of the peripheral pixel units are equal to each other, when a difference value between the representative values of the peripheral pixel units is less than a first threshold value, and determining that the representative values of the peripheral pixel units are different from each other, when the difference value between the representative values of the peripheral pixel units is more than the first threshold value.

In an exemplary embodiment, the method may further include determining that the representative values of the target and peripheral pixel units are equal to each other, when a difference value between the representative values of the peripheral pixel units is less than a second threshold value, and determining that the representative values of the target and peripheral pixel units are different from each other when the difference value between the representative values of the peripheral pixel units is more than the second threshold value.

In an exemplary embodiment, the plurality of comparison values may include a maximum value, a minimum value, a maximum difference value between the maximum value and the minimum value of the target pixel unit and the peripheral pixel units.

In an exemplary embodiment, the method may further include generating the normal gamma-data of the target pixel unit when the minimum value is less than the first threshold value.

In an exemplary embodiment, the method may further include generating the normal gamma-data of the target pixel unit when the maximum difference value is less than the second threshold value.

In an exemplary embodiment, the target pixel unit and the peripheral pixel units may be arranged as an (n×m) matrix array ('n' and 'm' are natural numbers and equal to or different from each other).

According to the inventive concept, a pixel unit displaying the special-pattern causing a display defect in both the time division method and space division method is detected, and then the pixel unit displaying the special-pattern may not be driven in both the time division method and space division method. Thus, the display defect such as a checker pattern, a flicker and so on may be reduced or eliminated.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Hereinafter, the inventive concept will be explained in detail with reference to the accompanying drawings.

Figure 1:
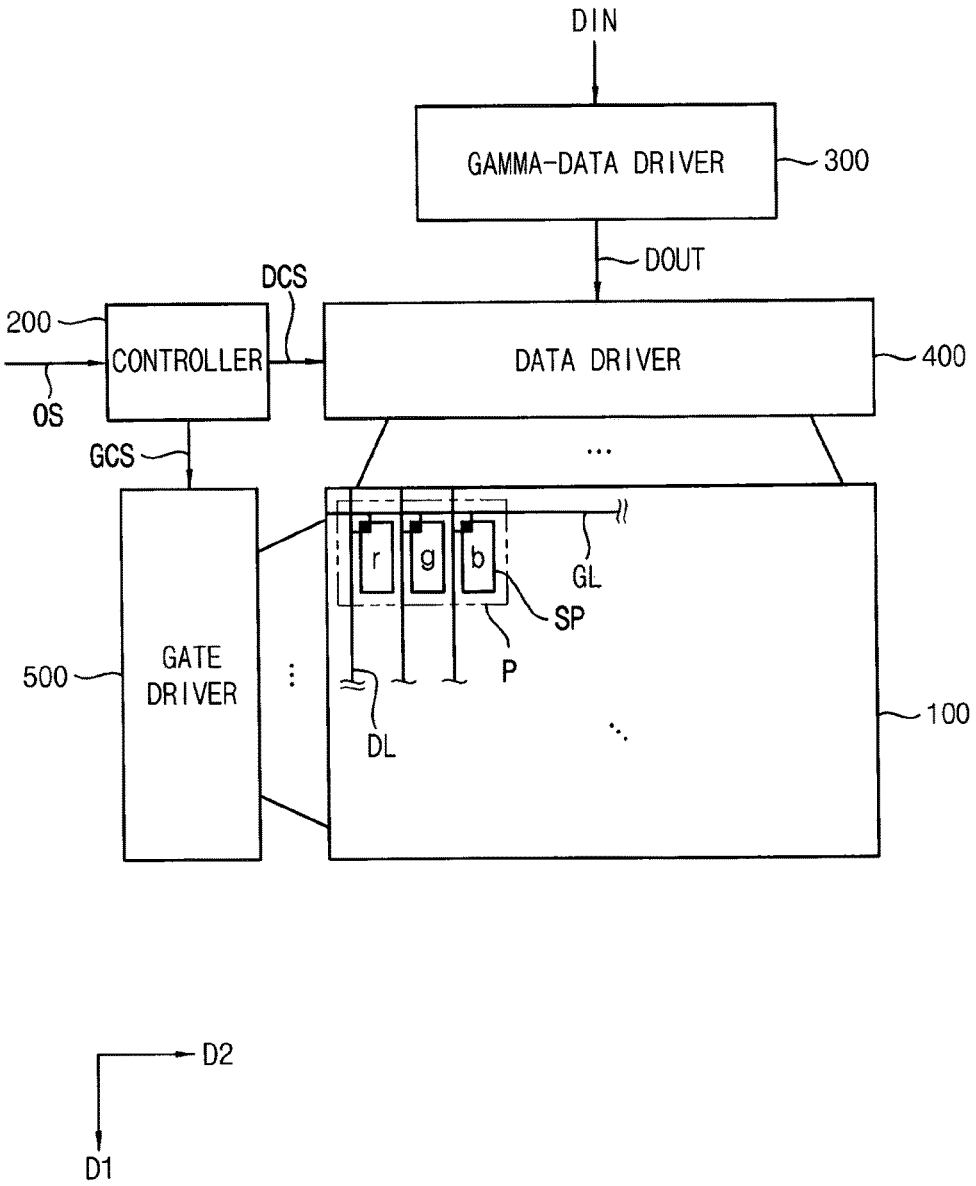
FIG. 1 is a block diagram illustrating a display apparatus according to an exemplary embodiment.
Figure 2:
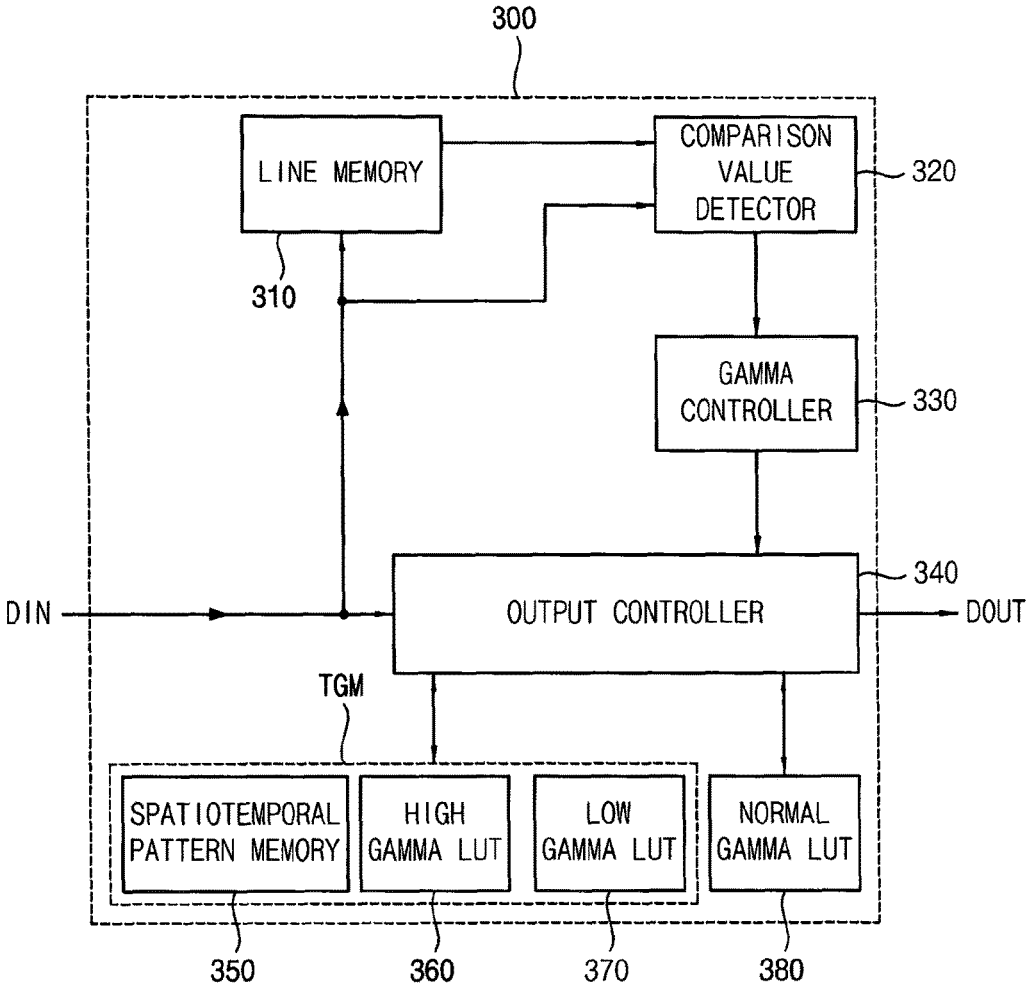
FIG. 2 is a block diagram illustrating a gamma-data driver of FIG. 1.
Figure 3:
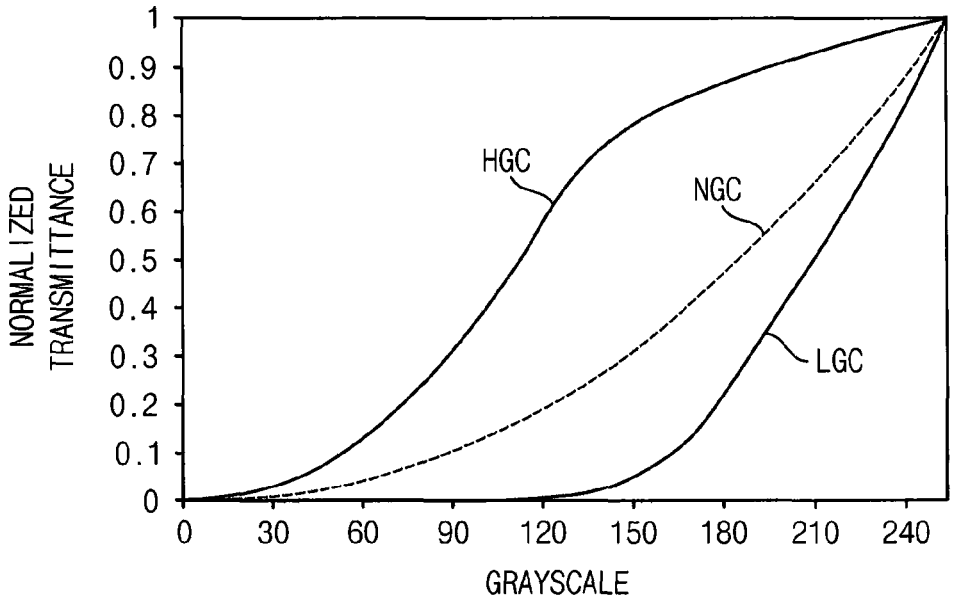
FIG. 3 is a conceptual diagram illustrating high, low and normal gamma LUTs of FIG. 1.

FIG. 1 is a block diagram illustrating a display apparatus according to an exemplary embodiment. FIG. 2 is a block diagram illustrating a gamma-data driver of FIG. 1. FIG. 3 is a conceptual diagram illustrating high, low and normal gamma LUTs of FIG. 1.

Referring to FIG. 1, the display apparatus may include a display panel 100, a controller 200, a gamma-data driver 300, a data driver 400 and a gate driver 500.

The display panel 100 may include a plurality of data lines DL, a plurality of gate lines GL and a plurality of pixel units P. The data lines DL extend in a first direction D1 and are arranged in a second direction D2 crossing the first direction D1. The gate lines GL extend in the second direction D2 and are arranged in the first direction D1. The pixel units P are arranged as a matrix array which includes a plurality of pixel columns and a plurality of pixel rows. Each of the pixel units P may include a plurality of sub-pixels SP. For example, a pixel unit P may include a red sub-pixel r, a green sub-pixel g and a blue sub-pixel b.

The controller 200 is configured to generally control an operation of the display apparatus. The controller 200 is configured to receive an original synch signal OS and to generate a plurality of control signals for driving the display panel 100 based on the original synch signal OS. The plurality of control signals may include a data control signal DCS for driving the data driver 400 and a gate control signal GCS driving the gate driver 500.

The data control signal DCS may include a horizontal synch signal, a vertical synch signal, a data enable signal, a polarity control signal and do on. The gate control signal GCS may include a vertical start signal, a gate clock signal, an output enable signal and so on.

The gamma-data driver 300 is configured to calculate a plurality of comparison values using data of a comparison group. The gamma-data driver 300 is configured to generate normal gamma-data of a target pixel unit in the comparison group using a normal gamma curve if the plurality of comparison values satisfy a reference condition (DOUT). The gamma-data driver 300 is configured to generate high and low gamma-data of the target pixel unit in the comparison group using a high gamma curve HGC and a low gamma curve LGC if the plurality of comparison values do not satisfy the reference condition (DOUT). The comparison group includes a plurality of pixel units as an (n×m) matrix array ('n' and 'm' are natural numbers and equal to or different from each other).

Referring to FIG. 2, the gamma-data driver 300 may include a line memory 310, a comparison value detector 320, a gamma controller 330, an output controller 340, a spatiotemporal processing unit TGM and a normal gamma look-up table ("LUT") 380. The spatiotemporal processing unit TGM may include a spatiotemporal pattern memory 350, a high gamma LUT 360 and a low gamma LUT 370.

The line memory 310 is configured to store sub-pixel data of the plurality of pixel units arranged as the (n×m) matrix array.

The comparison value detector 320 is configured to calculate a plurality of comparison values to detect a special-pattern causing a display defect, using the sub-pixel data of the plurality of pixel units.

The gamma controller 330 is configured to compare the plurality of comparison values with the reference condition and to determine whether the target pixel unit is driven in both time division method and space division method.

The output controller 340 is configured to generate the normal gamma-data of the target pixel using the normal gamma LUT 380 if the plurality of comparison values satisfy the reference condition. The output controller 340 is configured to generate high gamma-data and the low gamma-data of the target pixel through the spatiotemporal processing unit TGM in the both time division method and space division method if the plurality of comparison values do not satisfy the reference condition.

The spatiotemporal processing unit TGM may include a spatiotemporal pattern memory 350, a high gamma LUT 360 and a low gamma LUT 370.

The spatiotemporal pattern memory 350 includes at least one spatiotemporal sequential pattern. For example, the spatiotemporal pattern includes a spatial pattern which has a preset array of high data of the high gamma curve HGC and low data of the low gamma curve LGC corresponding to a plurality of sub-pixels arranged in a (p×q) matrix array, and a temporal pattern which has a preset sequence of the high and the low data corresponding to the sub-pixels during k frames ('p', 'q' and 'k' are natural numbers).

Referring to FIG. 3, the high gamma LUT 360 is configured to store the high gamma-data corresponding to input data of the sub-pixel based on the high gamma curve HGC. The high gamma LUT 360 may store the high gamma-data of the input data corresponding to a plurality of sample grayscales sampled of total grayscales. The high gamma-data of the input data corresponding to grayscales not sampled may be calculated using an interpolation.

The low gamma LUT 370 is configured to store the low gamma-data corresponding to the input data of the sub-pixel based on the low gamma curve LGC. The low gamma LUT 370 may store the low gamma-data of the input data corresponding to a plurality of sample grayscales sampled of the total grayscales. The low gamma-data of the input data corresponding to grayscales not sampled may be calculated using the interpolation.

The normal gamma LUT 380 is configured to store the normal gamma-data corresponding to the input data of the sub-pixel based on the normal gamma curve NGC. The normal gamma LUT 380 may store the normal gamma-data of the input data corresponding to a plurality of sample grayscales sampled of the total grayscales. The normal gamma-data of the input data corresponding to grayscales not sampled may be calculated using the interpolation.

The data driver 400 is configured to convert gamma data DOUT provided from the gamma-data driver 300 to a data voltage and to output the data voltage to the data line DL of the display panel 100.

The gate driver 500 is configured to generate a plurality of gate signals sequentially outputted to the gate line GL of the display panel 100.

Figure 4:
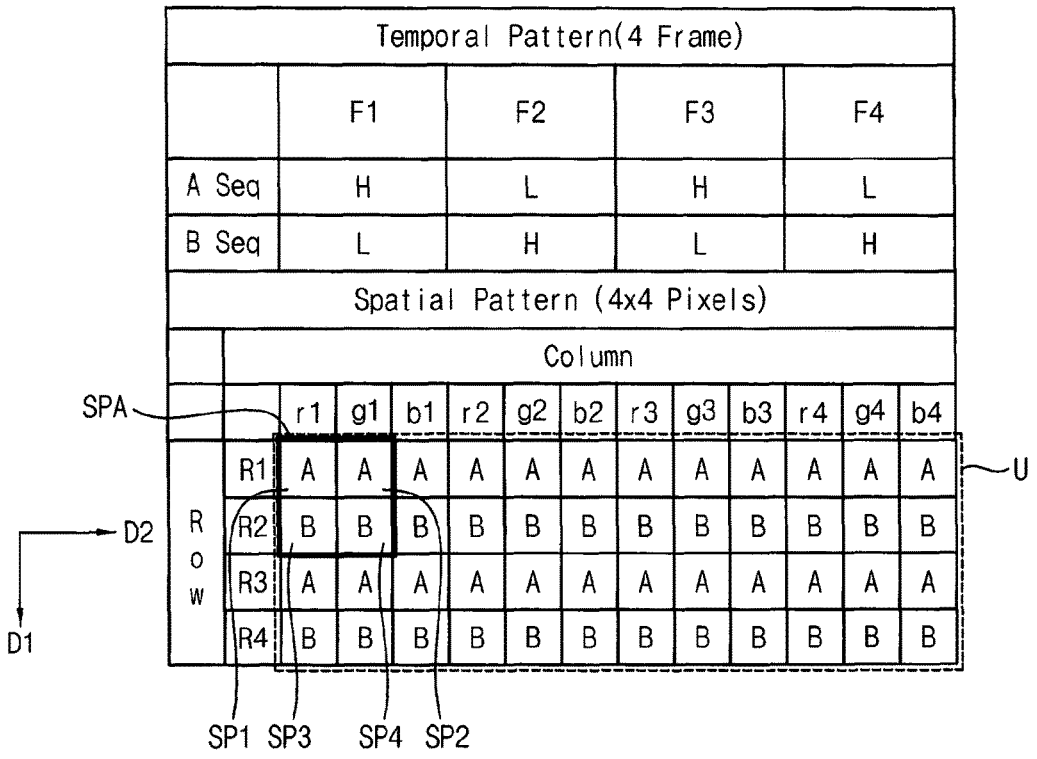
FIG. 4 is a conceptual diagram illustrating a spatiotemporal pattern memory of FIG. 2.

FIG. 4 is a conceptual diagram illustrating a spatiotemporal pattern memory of FIG. 2.

Referring to FIG. 4, the spatiotemporal pattern memory 350 includes a spatiotemporal pattern SPA. The spatiotemporal pattern SPA has a spatial array of sub pixels SP1, SP2, SP3 and SP4 arranged in a (2×2) matrix array and a temporal pattern which has a temporal sequence of the high and low data respectively corresponding to the sub pixels SP1, SP2, SP3 and SP4 during a plurality of frames, for example, 4 frames.

The temporal pattern includes a first sequence A and a second sequence B. For example, as shown in FIG. 4, the spatial pattern may have a spatial array U of sub pixels arranged in a (12×4) matrix array for increasing driving efficiency.

Referring to the sub-pixels SP1, SP2, SP3 and SP4 of the (2×2) matrix array, a first sub-pixel SP1 and a second sub-pixel SP2 adjacent to the first sub-pixel SP1 in the second direction D2 have the first sequence A. A third sub-pixel SP3 adjacent to the first sub-pixel SP1 in the first direction D1 and a fourth sub-pixel SP4 adjacent to the third sub-pixel SP3 in the second direction D2 have the second sequence B.

Each of the first and second sequences A and B has a preset sequence with respect to the high data H of the high gamma curve HGC and the low data L of the low gamma curve LGC.

For example, the gamma data DOUT of a sub pixel having the first sequence A has a sequence as "H→L→H→L" during 4 frames with respect to the high data H of the high gamma curve HGC and the low data L of the low gamma curve LGC. According to the first sequence A, the gamma data DOUT of the sub pixel are determined as the high data H during a first frame F1, the gamma data DOUT of the sub pixel are determined as the low data L during a second frame F2, the gamma data DOUT of the sub pixel are determined as the high data H during a third frame F3, and the gamma data DOUT of the sub pixel are determined as the low data L during a fourth frame F4.

The gamma data DOUT of a sub pixel having the second sequence B has a sequence as "L→H→L→H" during 4 frames with respect to the high data H of the high gamma curve HGC and the low data L of the low gamma curve LGC. According to the second sequence B, the gamma data DOUT of the sub pixel are determined as the low data L during a first frame F1, the gamma data DOUT of the sub pixel are determined as the high data H during a second frame F2, the gamma data DOUT of the sub pixel are determined as the low data L during a third frame F3, and the gamma data DOUT of the sub pixel are determined as the high data H during a fourth frame F4.

The temporal and spatial patterns of the spatiotemporal pattern SPA may be variously preset according to physical and driving characteristics of the display panel.

Although not shown in figures, the spatiotemporal processing unit TGM may be driven in both time division method and space division method using a plurality of gamma curves having gamma data between the high and low gamma curves.

In addition, the spatiotemporal pattern SPA may include only spatial pattern except for the temporal pattern.

Figure 5A:
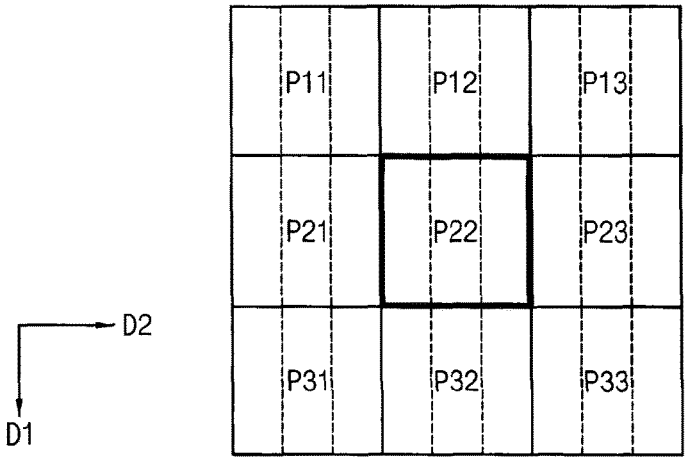
FIG. 5A is a conceptual diagram illustrating a comparison value detector according to an exemplary embodiment.
Figure 5B:
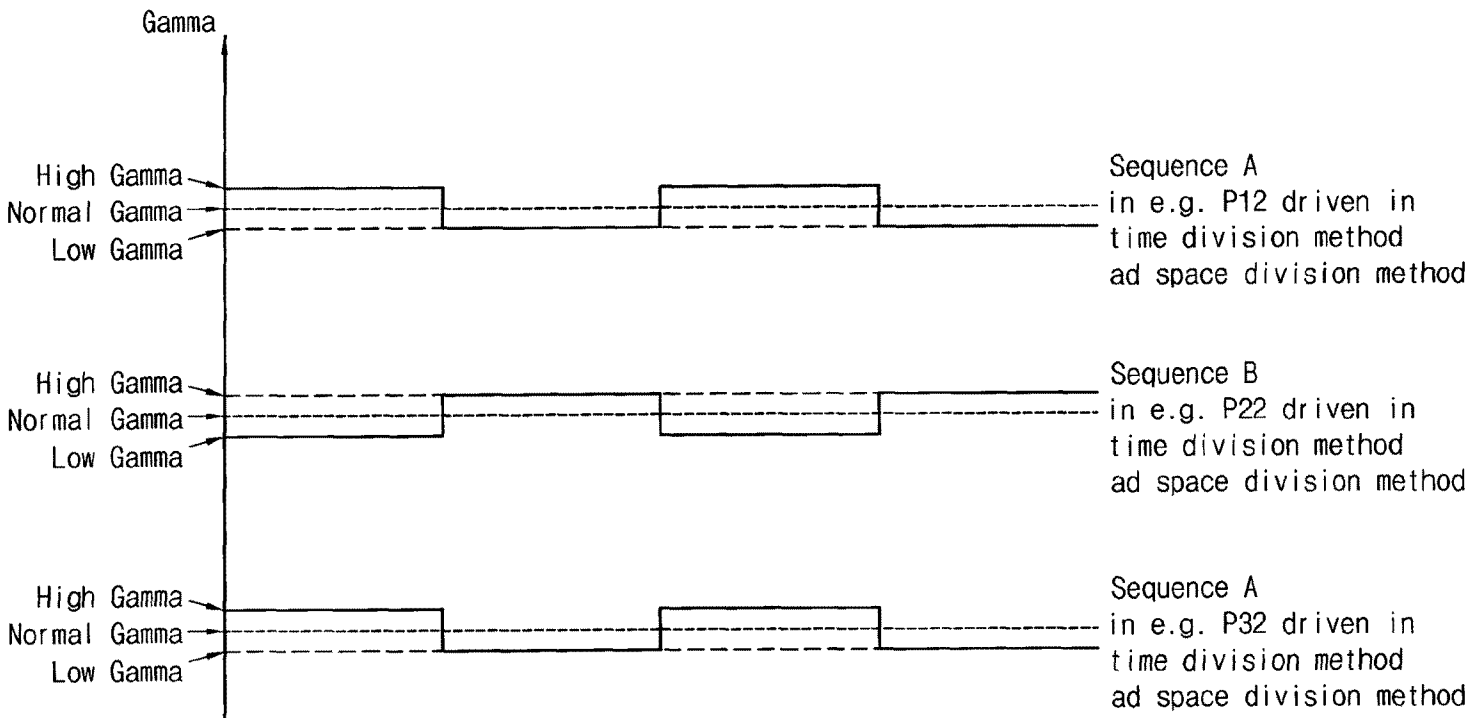
FIG. 5B is a diagram showing the sequence of gamma in pixels P12, P22, and P32 of FIG. 5A in four frames.
Figure 5C:
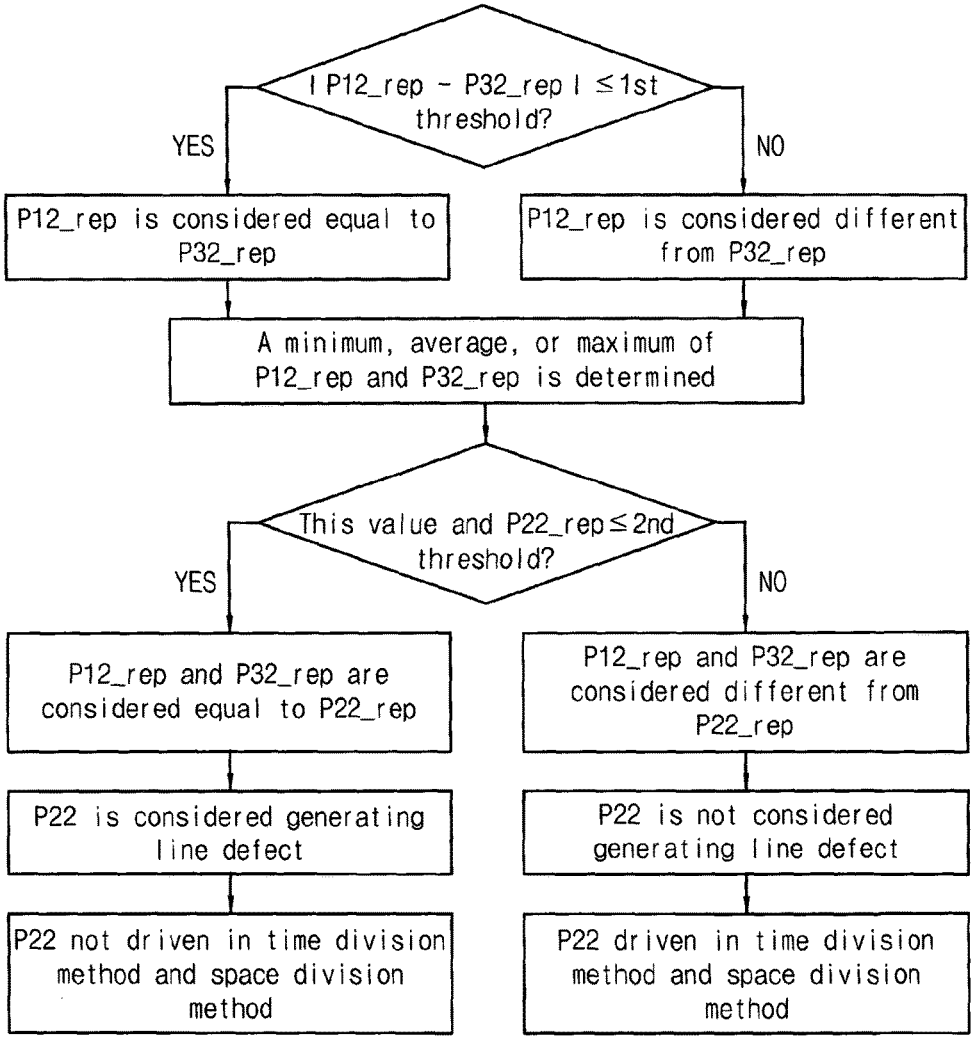
FIG. 5C is a flow-chart showing the process of determining if pixel P22 is driven in time division method and space division method, when compared with pixels P12 and P32 of FIG. 5A.
Figure 5D:
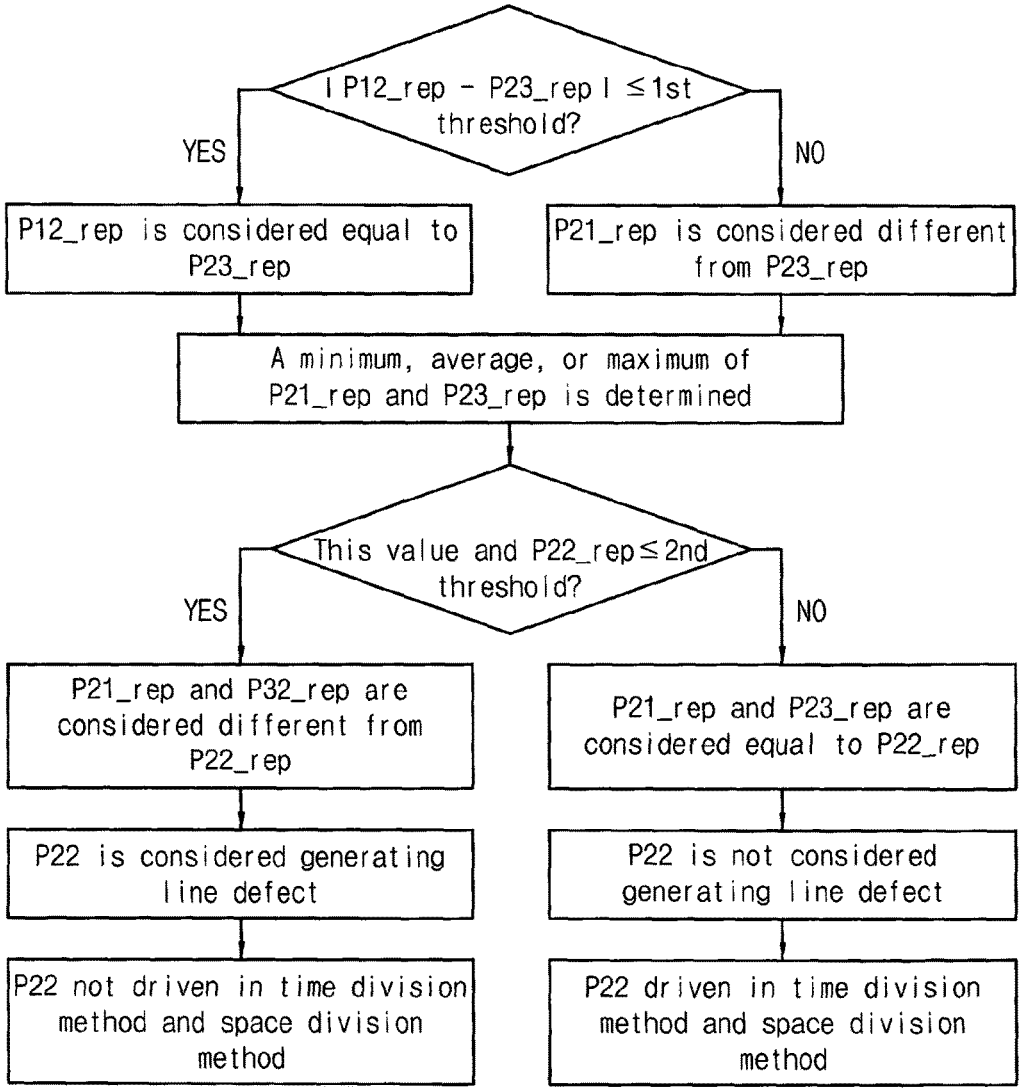
FIG. 5D is a flow-chart showing the process of determining if pixel P22 is driven in time division method and space division method, when compared with pixels P21 and P23 of FIG. 5A.
Figure 5E:
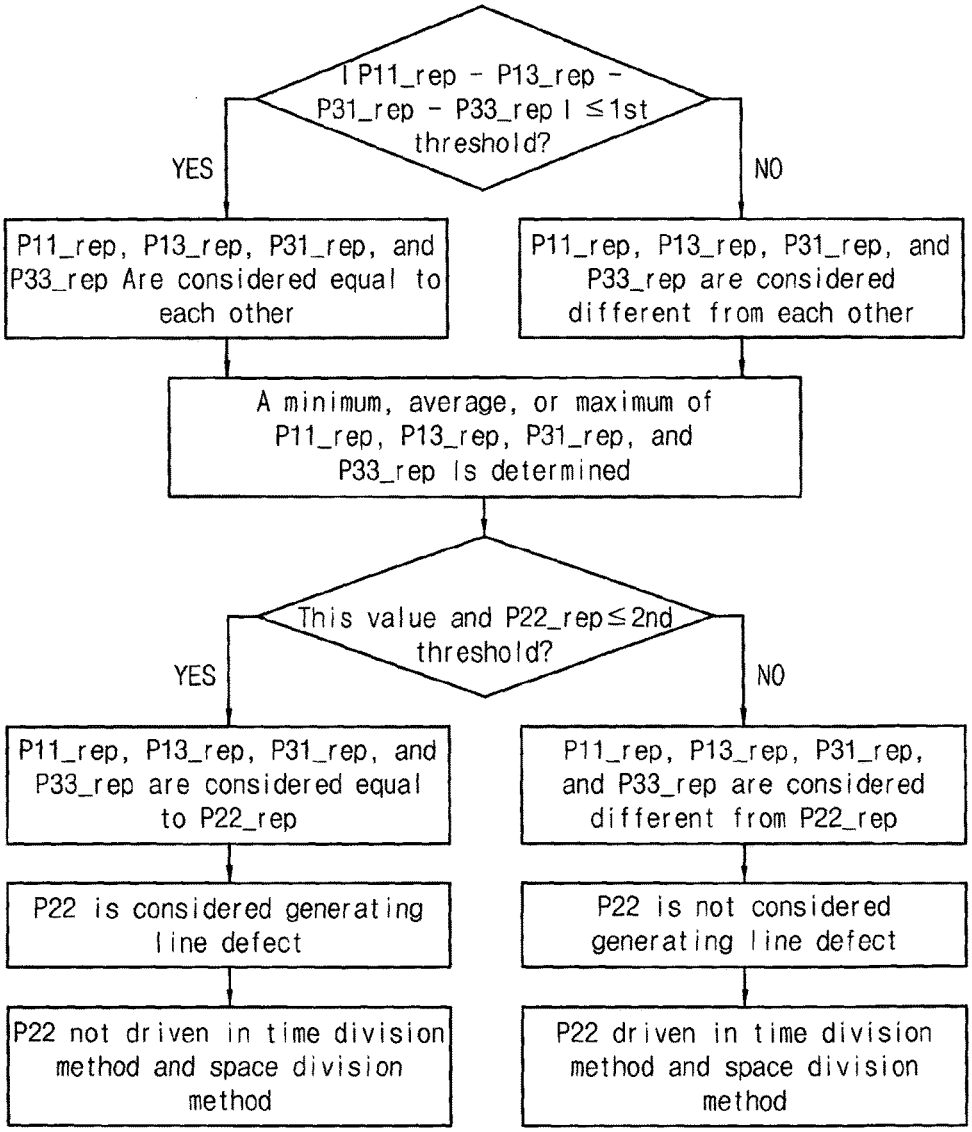
FIG. 5E is a flow-chart showing the process of determining if pixel P22 is driven in time division method and space division method, when compared with pixels P11, P13, P31, and P33 of FIG. 5A.

FIG. 5A is a conceptual diagram illustrating a comparison value detector according to an exemplary embodiment. FIG. 5B is a diagram showing the sequence of gamma in pixels P12, P22, and P32 of FIG. 5A in four frames. FIG. 5C is a flow-chart showing the process of determining if pixel P22 is driven in time division method and space division method, when compared with pixels P12 and P32 of FIG. 5A. FIG. 5D is a flow-chart showing the process of determining if pixel P22 is driven in time division method and space division method, when compared with pixels P21 and P23 of FIG. 5A. FIG. 5E is a flow-chart showing the process of determining if pixel P22 is driven in time division method and space division method, when compared with pixels P11, P13, P31, and P33 of FIG. 5A.

Figure 6:
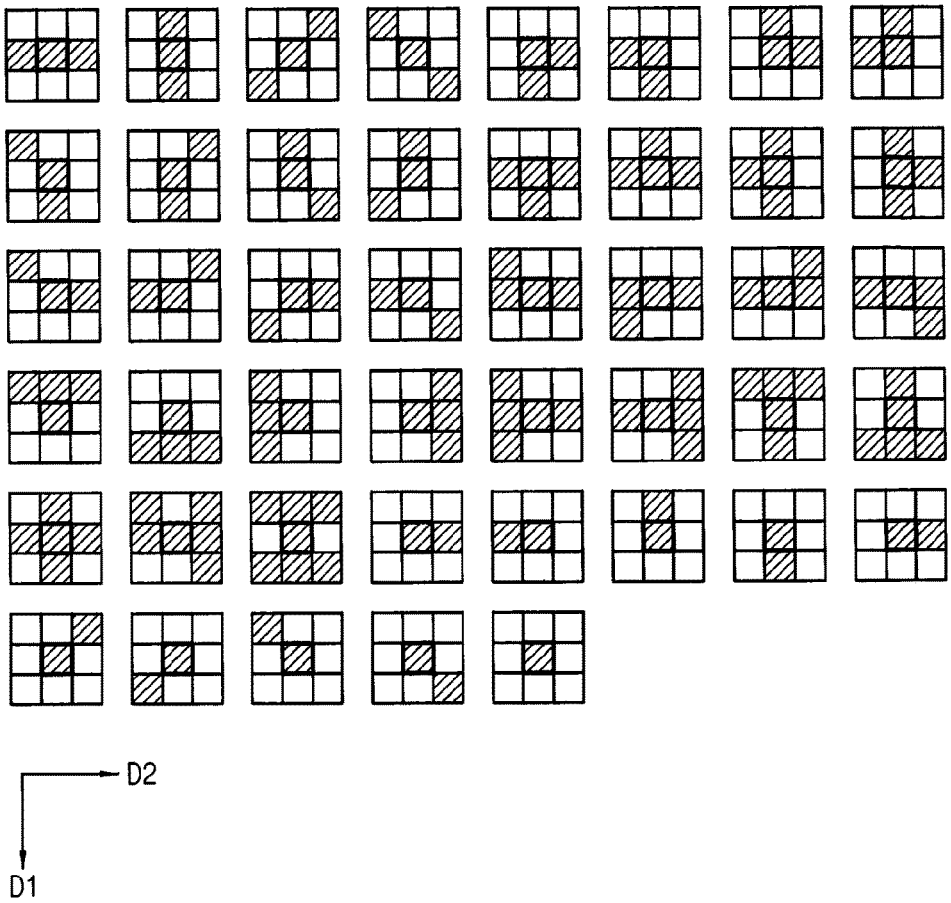
FIG. 6 is a conceptual diagram illustrating various line patterns based on Expression 1.

FIG. 6 is a conceptual diagram illustrating various line patterns based on Expression 1.

Referring to FIGS. 2 and 5A, according to the exemplary embodiment, the comparison value detector 320 may use a comparison group as a plurality of pixel units having a (3×3) matrix array that is, a plurality of sub-pixels having a (9×3) matrix array.

The comparison value detector 320 is configured to calculate a representative value of each of the pixel units as the comparison values. The representative value may be calculated as a maximum value, a minimum value or an average value of the red, green and blue data corresponding to the red, green and blue sub-pixels.

As shown in FIG. 5A, a first representative value P11_rep of a first pixel unit P11, a second representative value P12_rep of a second pixel unit P12, a third representative value P13_rep of a third pixel unit P13, a fourth representative value P21_rep of a fourth pixel unit P21, a fifth representative value P22_rep of a fifth pixel unit P22, a sixth representative value P23_rep of a sixth pixel unit P23, a seventh representative value P31_rep of a seventh pixel unit P31, an eighth representative value P32_rep of an eighth pixel unit P32 and a ninth representative value P33_rep of a ninth pixel unit P33 are calculated using sub-pixel data of sub-pixels as a (3×3) matrix array. FIG. 5B is a diagram showing an exemplary sequence of gamma in pixels P12, P22, and P32 of FIG. 5A in four frames.

As Expression 1 below, the gamma controller 330 is configured to compare the fifth representative value P22_rep of the fifth pixel unit P22 corresponding to a target pixel unit which is located to a central portion of the comparison group having the first, second, third, fourth, sixth, seventh, eighth and ninth representative values of the first, second, third, fourth, sixth, seventh, eighth and ninth pixel units P11, P12, P13, P21, P23, P31, P32 and P33 corresponding to peripheral pixels units in the comparison group which are located adjacent to the target pixel unit and to determine whether the fifth pixel unit P22 of the target pixel unit displays a line pattern as a display defect. The gamma controller 330 is configured to determine whether the fifth pixel unit P22 of the target pixel unit is driven in both time division method and space division method according to whether the fifth pixel unit P22 displays the line pattern.

$$\text{if}\left\{\begin{array}{l}(\text{P12_rep} = \text{P32_rep}) \neq (\text{P22_rep})\\ \text{or}\\ (\text{P21_rep} = \text{P23_rep}) \neq (\text{P22_rep})\\ \text{or}\\ (\text{P11_rep} = \text{P13_rep} = \text{P31_rep} = \text{P33_rep}) \neq (\text{P22_rep})\end{array}\right\} \rightarrow NOR \qquad \text{< Expression 1 >}$$

$$\text{else} \rightarrow TGM(H/\text{L_LUT})$$

For example, referring to Expression 1, when a difference value between the second representative value P12_rep of the second pixel unit P12 and the eighth representative value P32_rep of the eighth pixel unit P32 which is located opposite to the second pixel unit P12 in the first direction D1 is less than or equal to a first threshold value, the gamma controller 330 is configured to determine that the second and eighth representative values P12_rep and P32_rep are equal to each other. When the difference value between the second representative value P12_rep and the eighth representative value P32_rep are more than the first threshold value, the gamma controller 330 is configured to determine that the second and eighth representative values P12_rep and P32_rep are different from each other.

Then, a representative value of the second and eighth representative values P12_rep and P32_rep may be determined as a maximum value, a minimum value or an average value of the second and eighth representative values P12_rep and P32_rep. When a difference value between the representative value of the second and eighth representative values P12_rep and P32_rep and the fifth representative value P22_rep of the fifth pixel unit P22 is less than or equal to a second threshold value, the gamma controller 330 is configured to determine that the second and eighth representative values and the fifth representative value P22_rep are equal to each other. When the difference value between the representative value of the second and eighth representative values P12_rep and P32_rep and the fifth representative value P22_rep is more than the second threshold value, the gamma controller 330 is configured to determine that the second and eighth representative values and the fifth representative value P22_rep are different from each other.

When the second and eighth representative values P12_rep and P32_rep are equal to each other and the second and eighth representative values P12_rep and P32_rep are different from the fifth representative value P22_rep, the gamma controller 330 is configured to determine that the fifth pixel unit P22 displays a line pattern causing display defect and control the fifth pixel unit P22 not to be driven in the time division method and space division method.

Then, the gamma controller 330 is configured to control the output controller 340 to use the normal gamma LUT 380 to generate gamma-data DOUT of red, green and blue data corresponding to the fifth pixel unit P22.

However, when the second and eighth representative values P12_rep and P32_rep are equal to each other and the second and eighth representative values P12_rep and P32_rep are equal to the fifth representative value P22_rep, the gamma controller 330 is configured to determine that the fifth pixel unit P22 does not display a line pattern occurring as a display defect and control the fifth pixel unit P22 to be driven in the time division method and space division method.

Then, the gamma controller 330 is configured to control the output controller 340 to drive the fifth pixel unit P22 in both time division method and space division method. The output controller 340 is configured to drive the spatiotemporal processing unit TGM. The spatiotemporal processing unit TGM is configured to generate high and low gamma-data DOUT corresponding to the red, green and blue data of the fifth pixel unit P22. These steps are shown in the flow-chart in FIG. 5C.

Alternatively, when a difference value between a fourth representative value P21_rep of the fourth pixel unit P21 and a sixth representative value P23_rep of a sixth pixel unit P23 which is located adjacent to the fourth pixel unit P21 in the second direction D2 is less than or equal to the first threshold value, the gamma controller 330 is configured to determine that the fourth and sixth representative values P21_rep and P23_rep are equal to each other. When the difference value between the fourth representative value P21_rep and the sixth representative value P23_rep is more than the first threshold value, the gamma controller 330 is configured to determine that the fourth and sixth representative values P21_rep and P23_rep are different from each other.

Then, a representative value of the fourth and sixth representative values may be determined as a maximum value, a minimum value or an average value of the fourth and sixth representative values P21_rep and P23_rep. When a difference value between the representative value of the fourth and sixth representative values P21_rep and P23_rep and the fifth representative value P22_rep is less than or equal to a second threshold value, the gamma controller 330 is configured to determine that the fourth and sixth representative values P21_rep and P23_rep and the fifth representative value P22_rep are equal to each other. When a difference value between the representative value of the fourth and sixth representative values P21_rep and P23_rep and the fifth representative value P22_rep is more than the second threshold value, the gamma controller 330 is configured to determine that the fourth and sixth representative values P21_rep and P23_rep are different from the fifth representative value P22_rep.

When the fourth and sixth representative values P21_rep and P23_rep are equal to each other and the fourth and sixth representative values P21_rep and P23_rep are different from the fifth representative value P22_rep, the gamma controller 330 is configured to determine that the fifth pixel unit P22 displays a line pattern causing a display defect and control the fifth pixel unit P22 not to be driven in the time division method and space division method.

Then, the gamma controller 330 is configured to control the output controller 340 to use the normal gamma LUT 380 to generate gamma-data DOUT of red, green and blue data corresponding to the fifth pixel unit P22.

However, when the fourth and sixth representative values P21_rep and P23_rep are equal to each other and the fourth and sixth representative values P21_rep and P23_rep are equal to the fifth representative value P22_rep, the gamma controller 330 is configured to determine that the fifth pixel unit P22 does not display a line pattern as a display defect and control the fifth pixel unit P22 to be driven in the time division method and space division method.

Then, the gamma controller 330 is configured to control the output controller 340 to drive the fifth pixel unit P22 in both time division method and space division method. The output controller 340 is configured to drive the spatiotemporal processing unit TGM. The spatiotemporal processing unit TGM is configured to generate high and low gamma-data DOUT corresponding to the red, green and blue data of the fifth pixel unit P22. These steps are shown in the flow-chart in FIG. 5D.

Alternatively, when difference values between a first representative value P11_rep of the first pixel unit P11, a third representative value P13_rep of the third pixel unit P13, a seventh representative value P31_rep of the seventh pixel unit P31 and a ninth representative value P33_rep of the ninth pixel unit P33 is less than or equal to the first threshold value, the gamma controller 330 is configured to determine that the first, third, seventh and ninth representative values P11_rep, P13_rep, P31_rep and P33_rep are equal to each other. When difference values between a first representative value P11_rep of the first pixel unit P11, a third representative value P13_rep of the third pixel unit P13, a seventh representative value P31_rep of the seventh pixel unit P31 and a ninth representative value P33_rep of the ninth pixel unit P33 is more than the first threshold value, the gamma controller 330 is configured to determine that the first, third, seventh and ninth representative values P11_rep, P13_rep, P31_rep and P33_rep are different from each other.

Then, a representative value of the first, third, seventh and ninth representative values P11_rep, P13_rep, P31_rep and P33_rep may be determined as a maximum value, a minimum value or an average value of the first, third, seventh and ninth representative values P11_rep, P13_rep, P31_rep and P33_rep. When a difference value between the representative value of the first, third, seventh and ninth representative values P11_rep, P13_rep, P31_rep and P33_rep and the fifth representative value P22_rep is less than or equal to the second threshold value, the gamma controller 330 is configured to determine that the first, third, seventh and ninth representative values P11_rep, P13_rep, P31_rep and P33_rep are equal to the fifth representative value P22_rep. When a difference value between the representative value of the first, third, seventh and ninth representative values P11_rep, P13_rep, P31_rep and P33_rep and the fifth representative value P22_rep is more than the second threshold value, the gamma controller 330 is configured to determine that the first, third, seventh and ninth representative values P11_rep, P13_rep, P31_rep and P33_rep are different from the fifth representative value P22_rep.

When the first, third, seventh and ninth representative values P11_rep, P13_rep, P31_rep and P33_rep are equal to each other and the first, third, seventh and ninth representative values P11_rep, P13_rep, P31_rep and P33_rep are equal to the fifth representative value P22_rep, the gamma controller 330 is configured to determine that the fifth pixel unit P22 displays a line pattern causing a display defect and to control the fifth pixel unit P22 not to be driven in the time division method and space division method.

Then, the gamma controller 330 is configured to control the output controller 340 to use the normal gamma LUT 380 to generate normal gamma-data DOUT of red, green and blue data corresponding to the fifth pixel unit P22 using the normal gamma LUT 380.

However, when the first, third, seventh and ninth representative values P11_rep, P13_rep, P31_rep and P33_rep are equal to each other and the first, third, seventh and ninth representative values P11_rep, P13_rep, P31_rep and P33_rep are different from the fifth representative value P22_rep, the gamma controller 330 is configured to determine that the fifth pixel unit P22 does not display a line pattern causing a display defect and control the fifth pixel unit P22 to be driven in the time division method and space division method.

Then, the gamma controller 330 is configured to control the output controller 340 to drive the fifth pixel unit P22 in both time division method and space division method. The output controller 340 is configured to drive the spatiotemporal processing unit TGM. The spatiotemporal processing unit TGM is configured to generate high and low gamma-data DOUT corresponding to the red, green and blue data of the fifth pixel unit P22. These steps are shown in the flow-chart in FIG. 5E.

Referring to FIG. 6, according to the Expression 1, the comparison group may include various line patterns as shown in FIG. 6.

A one-line pattern in a moving image having a PPF (Pixel per Frame) speed that may not be spatially divided into high and low gamma curves HGC and LGC. In other words, the one-line pattern in a static image does not cause a line-artifact such as a line cut, a disappearance and so on, but the one-line pattern in the moving image causes the line-artifact.

According to the exemplary embodiment, the line pattern causing the line-artifact is detected, the pixel unit displaying the line pattern is controlled to be not driven in the time division method and the space division method and thus the pixel unit displaying the line pattern is driven using a normal gamma curve NGC. Therefore, the line-artifact may be reduced or eliminated.

Figure 7:
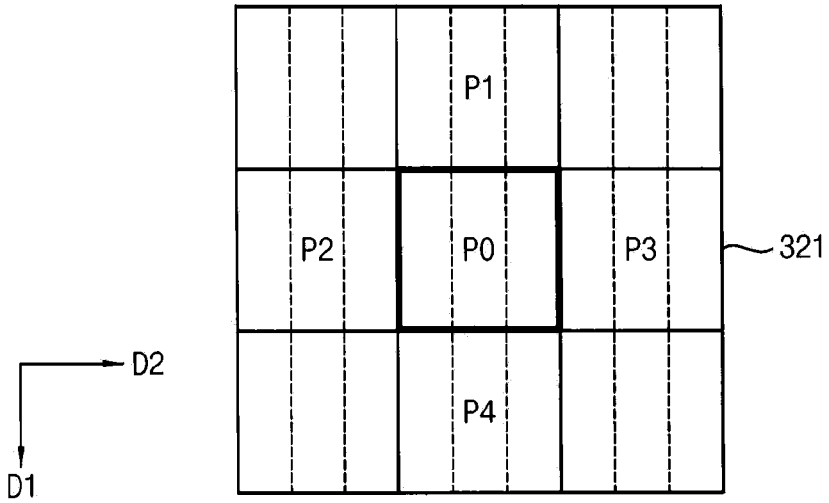
FIG. 7 is a conceptual diagram illustrating a comparison value detector according to an exemplary embodiment.

FIG. 7 is a conceptual diagram illustrating a comparison value detector according to an exemplary embodiment.

Referring to FIGS. 2 and 7, according to the exemplary embodiment, a comparison group 321 includes a plurality of pixel units arranged as a (3×3) matrix array. A target pixel unit P0 is located at a central portion of the a comparison group 321 and four peripheral pixel units are respectively located at upper, lower, left and right sides of the target pixel unit P0. As shown in FIG. 7. The four peripheral pixel units include first, second, third and fourth pixel units P1, P2, P3 and P4. Each of the pixel units includes red, green and blue sub-pixels of three.

When the comparison group 321 includes the target pixel unit P0 and N peripheral pixel units, the comparison value detector 320 is configured to calculate a plurality of comparison values as following Expression 2.

$$M_R=\mathrm{MAX}[P_0(R),P_1(R),\ldots,P_N(R)]$$

$$m_R=\min[P_0(R),P_1(R),\ldots,P_N(R)]$$

$$M_R=\mathrm{MAX}[P_0(G),P_1(G),\ldots,P_N(G)]$$

$$m_R=\min[P_0(G),P_1(G),\ldots,P_N(G)]$$

$$M_R=\mathrm{MAX}[P_0(B),P_1(B),\ldots,P_N(B)]$$

$$m_R=\min[P_0(B),P_1(B),\ldots,P_N(B)]$$

$$M_{RGB}=\mathrm{MAX}(M_R,M_G,M_B)$$

$$M_{grad}=\mathrm{MAX}(M_R-m_R,M_G-m_G,M_B-m_B) \quad \text{<Expression 2>}$$

The plurality of comparison values include a red maximum value MR, a red minimum value mR, a green maximum value MG, a green minimum value mG, a blue maximum value MB, a blue minimum value mB, a color maximum value MRGB and a maximum difference value Mgrad.

According to the comparison group 321 as shown in FIG. 7, the value of N is four.

The gamma controller 330 is configured to detect whether the target pixel unit P0 displays a special-pattern causing a display defect using the red maximum value MR, the red minimum value mR, the green maximum value MG, the green minimum value mG, the blue maximum value MB, the blue minimum value mB, the color maximum value MRGB and the maximum difference value Mgrad. The gamma controller 330 is configured to determine whether the target pixel unit P0 is driven in both time division method and space division method according to a detection result.

In general, the special-pattern causing display defect in both the time division method and space division method, includes a low-grayscale pattern displayed in a low-grayscale image using the high gamma curve HGC and a single color pattern displaying a single grayscale in which a change is almost not occurred, in a predetermined image.

Thus, based on the following Expression 3, the gamma controller 330 is configured to detect whether the target pixel unit P0 displays the low grayscale pattern LOW-GRAYSCALE and the single color pattern SINGLE-COLOR.

| <Expression 3> | |
|---|---|
| LOW-GRAYSCALE DETECTION | |
| if MRGB < Th_low | then NOR_LUT |
| else if MR < Th_Rlow | then NOR_LUT |
| else if MG < Th_Glow | then NOR_LUT |
| else if MB < Th_Blow | then NOR_LUT |
| SINGLE-COLOR DETECTION | |
| if Mgrad < Th_grad | then NOR_LUT |

Referring to Expressions 2 and 3, the gamma controller 330 is configured to detect whether the target pixel unit P0 displays the low grayscale pattern LOW-GRAYSCALE based on the target pixel unit P0 and the peripheral pixel units P1, P2, P3 and P4.

For example, when the color maximum value MRGB is less than a minimum threshold value Th_low, the gamma controller 330 is configured to not drive the spatiotemporal processing unit TGM and to control the output controller 340 to use the normal gamma LUT 380. Therefore, the output controller 340 is configured to generate normal gamma-data respectively corresponding to red, green and blue data of the target pixel unit P0 using the normal gamma LUT 380.

In addition, when the red maximum value MR is less than a minimum red threshold value Th_Rlow, the gamma controller 330 is configured to not drive the spatiotemporal processing unit TGM and to control the output controller 340 to use the normal gamma LUT 380. Therefore, the output controller 340 is configured to generate normal gamma-data respectively corresponding to red, green and blue data of the target pixel unit P0 using the normal gamma LUT 380.

In addition, the green maximum value MG is less than a minimum green threshold value Th_Glow, the gamma controller 330 is configured to not drive the spatiotemporal processing unit TGM and to control the output controller 340 to use the normal gamma LUT 380. Therefore, the output controller 340 is configured to generate normal gamma-data respectively corresponding to red, green and blue data of the target pixel unit P0 using the normal gamma LUT 380.

In addition, the blue maximum value MB is less than a minimum blue threshold value Th_Blow, the gamma controller 330 is configured to not drive the spatiotemporal processing unit TGM and to control the output controller 340 to use the normal gamma LUT 380. Therefore, the output controller 340 is configured to generate normal gamma-data respectively corresponding to red, green and blue data of the target pixel unit P0 using the normal gamma LUT 380.

However, if the target pixel unit P0 does not satisfy reference conditions of the low grayscale pattern, the gamma controller 330 is configured to control the output controller 340 to drive the spatiotemporal processing unit TGM. Therefore, the output controller 340 is configured to drive the spatiotemporal processing unit TGM. The spatiotemporal processing unit TGM is configured to generate high or low gamma-data respectively corresponding to red, green and blue data of the target pixel unit P0 based on a spatiotemporal pattern SPA.

Then, the gamma controller 330 is configured to detect whether the target pixel unit P0 corresponds to the single color pattern SINGLE-COLOR based on the target pixel unit P0 and the peripheral pixel units P1, P2, P3 and P4 as referring to Expressions 2 and 3.

For example, the maximum difference value Mgrad is less than a difference threshold value Th_grad, the gamma controller 330 is configured to not drive the spatiotemporal processing unit TGM and to control the output controller 340 to use the normal gamma LUT 380. Therefore, the output controller 340 is configured to generate normal gamma-data respectively corresponding to red, green and blue data of the target pixel unit P0 using the normal gamma LUT 380.

However, if the target pixel unit P0 does not satisfy reference conditions of the single color pattern, the gamma controller 330 is configured to control the output controller 340 to drive the spatiotemporal processing unit TGM. Therefore, the output controller 340 is configured to drive the spatiotemporal processing unit TGM. The spatiotemporal processing unit TGM is configured to generate high or low gamma-data respectively corresponding to red, green and blue data of the target pixel unit P0 based on a spatiotemporal pattern SPA.

According to the exemplary embodiment, a pixel unit displaying the special-pattern in both the time division method and space division method is detected, and then the pixel unit displaying the special-pattern may not be driven in both the time division method and space division method. Thus, the display defect such as a checker pattern, a flicker and so on may be reduced or eliminated.

Figure 8A:
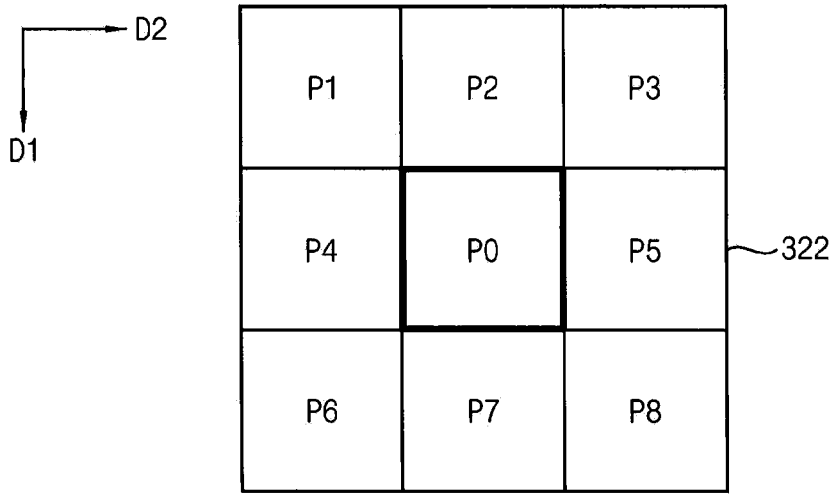
FIGS. 8A and 8B are conceptual diagrams illustrating various comparison groups.
Figure 8B:
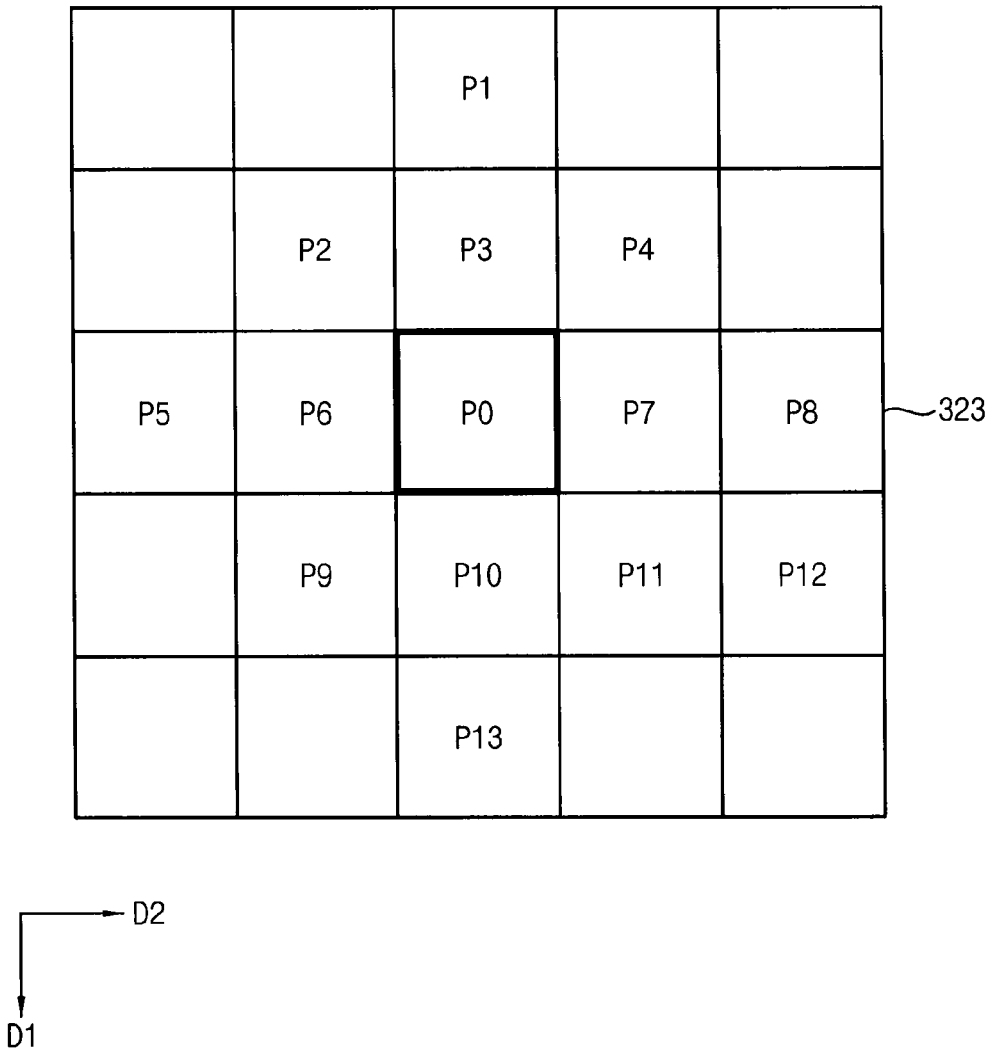

FIGS. 8A and 8B are conceptual diagrams illustrating various comparison groups.

Referring to FIG. 8A, according to the exemplary embodiment, a comparison group 322 includes a plurality of pixel units arranged as a (3×3) matrix array. The comparison group 322 include a target pixel unit P0 which is located at a central portion of the (3×3) matrix array and 8 peripheral pixel units which are first, second, third, fourth, fifth, sixth, seventh and eighth pixel units P1, P2, P3, P4, P5, P6, P7 and P8 surrounding the target pixel unit P0. Each of the pixel units includes red, green and blue sub-pixels.

According to the exemplary embodiment, the comparison value detector 320 is configured to calculate a plurality of comparison values using red, green and blue data of the target pixel unit P0 and the 8 peripheral pixel units P1, P2, P3, P4, P5, P6, P7 and P8 as referring to Expression 2. The plurality of comparison values include the red maximum value MR, the red minimum value mR, the green maximum value MG, the green minimum value mG, the blue maximum value MB, the blue minimum value mB, the color maximum value MRGB and the maximum difference value Mgrad.

Referring to FIG. 8B, according to the exemplary embodiment, a comparison group 323 includes a plurality of pixel units arranged as a (5×5) matrix array. The comparison group 323 include a target pixel unit P0 which is located at a central portion of the (5×5) matrix array and 13 peripheral pixel units which include first, second, third, fourth, fifth, sixth, seventh, eighth, ninth, tenth, eleventh, twelfth and thirteenth pixel units P1, P2, P3, P4, P5, P6, P7, P8, P9, P10, P11, P12 and P13 surrounding the target pixel unit P0. Each of the pixel units includes red, green and blue sub-pixels.

According to the exemplary embodiment, the comparison value detector 320 is configured to calculate a plurality of comparison values using red, green and blue data of the target pixel unit P0 and the 13 peripheral pixel units P1, P2, P3, P4, P5, P6, P7, P8, P9, P10, P11, P12 and P13 as referring to Expression 2. The plurality of comparison values includes the red maximum value MR, the red minimum value mR, the green maximum value MG, the green minimum value mG, the blue maximum value MB, the blue minimum value mB, the color maximum value MRGB and the maximum difference value Mgrad.

The comparison group does not limited as described above, and the comparison group may include a plurality of pixel units as a (p×q) matrix array ('p' and 'q' are natural numbers, equal to or different from each other).

As described above, according to exemplary embodiments, a pixel unit displaying the special-pattern in both the time division method and space division method is detected, and then the pixel unit displaying the special-pattern may not be driven in both the time division method and space division method. Thus, the display defect such as a checker pattern, a flicker and so on may be reduced or eliminated.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A display apparatus comprising:

a comparison value detector configured to calculate a plurality of comparison values using data of a target pixel unit and a plurality of peripheral pixel units adjacent to the target pixel unit;

a gamma controller configured to determine whether the target pixel unit is driven in both time division method and space division method based on the plurality of comparison values and a reference condition;

an output controller configured to generate normal gamma-data of the target pixel unit using a normal gamma curve if the plurality of comparison values satisfy the reference condition and to generate high gamma-data and low gamma-data of the target pixel unit using a high gamma curve and a low gamma curve in both time division method and space division method if the plurality of comparison values do not satisfy the reference condition; and a data driver configured to convert gamma data of the target pixel unit to a data voltage and to output the data voltage to a display panel.

2. The display apparatus of claim 1, further comprising a line memory configured to store data of the target pixel unit and the peripheral pixel units.

3. The display apparatus of claim 1, wherein the plurality of comparison values comprise a representative value of the target pixel unit and representative values of the peripheral pixel units.

4. The display apparatus of claim 3, wherein when the representative values of the peripheral pixel units are equal to each other and different from the representative value of the target pixel unit, the output controller is configured to generate the normal gamma-data of the target pixel unit.

5. The display apparatus of claim 4, wherein the gamma controller is configured to determine that the representative values of the peripheral pixel units are equal to each other when a difference value between the representative values of the peripheral pixel units is less than a first threshold value, and to determine that the representative values of the peripheral pixel units are different from each other when the difference value between the representative values of the peripheral pixel units is more than the first threshold value.

6. The display apparatus of claim 4, wherein the gamma controller is configured to determine that the representative values of the target and peripheral pixel units are equal to each other when a difference value between the representative values of the peripheral pixel units is less than a second threshold value, and to determine that the representative values of the target and peripheral pixel units are different from each other when the difference value between the representative values of the peripheral pixel units is more than the second threshold value.

7. The display apparatus of claim 5, wherein the plurality of comparison values comprise a maximum value, a minimum value, a maximum difference value between the maximum value and the minimum value of the target pixel unit and the peripheral pixel units.

8. The display apparatus of claim 7, wherein the output controller is configured to generate the normal gamma-data of the target pixel unit when the minimum value is less than the first threshold value.

9. The display apparatus of claim 7, wherein the output controller is configured to generate the normal gamma-data of the target pixel unit when the maximum difference value is less than the second threshold value.

10. The display apparatus of claim 3, wherein the target pixel unit and the peripheral pixel units are arranged as an (n×m) matrix array ('n' and 'm' are natural numbers and equal to or different from each other).

11. The display apparatus of claim 10, wherein the target pixel unit is located at a central area in the (n×m) matrix array.

12. A method of driving a display apparatus, the method comprising:

calculating a plurality of comparison values using data of a target pixel unit and a plurality of peripheral pixel units adjacent to the target pixel unit;

determining whether the target pixel unit is driven in both time division method and space division method based on the plurality of comparison values and a reference condition;

generating normal gamma-data of the target pixel unit using a normal gamma curve if the plurality of comparison values satisfy the reference condition;

generating high gamma-data and low gamma-data of the target pixel unit using a high gamma curve and a low gamma curve in both time division method and space division method if the plurality of comparison values do not satisfy the reference condition; and converting gamma data of the target pixel unit to a data voltage to output the data voltage to a display panel.

13. The method of claim 12, wherein the plurality of comparison values comprise a representative value of the target pixel unit and representative values of the peripheral pixel units.

14. The method of claim 13, further comprising:

generating the normal gamma-data of the target pixel unit, when the representative values of the peripheral pixel units are equal to each other and different from the representative value of the target pixel unit.

15. The method of claim 14, further comprising:

determining that the representative values of the peripheral pixel units are equal to each other, when a difference value between the representative values of the peripheral pixel units is less than a first threshold value, and determining that the representative values of the peripheral pixel units are different from each other, when the difference value between the representative values of the peripheral pixel units is more than the first threshold value.

16. The method of claim 14, further comprising:

determining that the representative values of the target and peripheral pixel units are equal to each other, when a difference value between the representative values of the peripheral pixel units is less than a second threshold value, and determining that the representative values of the target and peripheral pixel units are different from each other when the difference value between the representative values of the peripheral pixel units is more than the second threshold value.

17. The method of claim 15, wherein the plurality of comparison values comprise a maximum value, a minimum value, a maximum difference value between the maximum value and the minimum value of the target pixel unit and the peripheral pixel units.

18. The method of claim 17, further comprising:

generating the normal gamma-data of the target pixel unit when the minimum value is less than the first threshold value.

19. The method of claim 17, further comprising:

generating the normal gamma-data of the target pixel unit when the maximum difference value is less than the second threshold value.

20. The method of claim 12, wherein the target pixel unit and the peripheral pixel units are arranged as an (n×m) matrix array ('n' and 'm' are natural numbers and equal to or different from each other).

* * * * *